US006824034B2

(12) United States Patent
Sprenger et al.

(10) Patent No.: US 6,824,034 B2
(45) Date of Patent: Nov. 30, 2004

(54) SETTING TOOL

(75) Inventors: Markus Sprenger, Mauren (LI); Gebhard Gantner, Nenzing (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/638,178

(22) Filed: Aug. 7, 2003

(65) Prior Publication Data

US 2004/0094595 A1 May 20, 2004

(30) Foreign Application Priority Data

Aug. 8, 2002 (DE) ..... 102 36 482

(51) Int. Cl.[7] ..... B27F 7/17; B26D 5/00
(52) U.S. Cl. ..... 227/8; 83/399; 192/129 R
(58) Field of Search ..... 227/8; 83/399; 192/129 R

(56) References Cited

U.S. PATENT DOCUMENTS 3,558,032 A * 1/1971 Oefinger ..... 227/8
3,652,003 A * 3/1972 Leonardo et al. ..... 227/10
3,746,235 A * 7/1973 Crabtree, Jr. ..... 227/10
4,066,198 A * 1/1978 Jochum et al. ..... 227/8
4,068,790 A * 1/1978 Osterle et al. ..... 227/8
4,651,912 A * 3/1987 Hawkins ..... 227/8
4,877,171 A * 10/1989 Almeras ..... 227/10
5,465,893 A * 11/1995 Thompson ..... 227/8
5,996,875 A * 12/1999 Clark et al. ..... 227/10
6,015,078 A * 1/2000 Almeras et al. ..... 227/10

* cited by examiner

*Primary Examiner*—Eugene Kim
*Assistant Examiner*—Brian D Nash
(74) *Attorney, Agent, or Firm*—Sidley Austin Brown & Wood, LLP

(57) ABSTRACT

A setting tool includes a piston guide (13) displaceably arranged in the housing (11), a bolt guide (12) connection element (16) for fixedly connecting the bolt guide (12) with the piston guide (13) for joint displacement therewith, and a locking member (23) provided on the setting tool (10) and having a locking position (27) in which displacement of the bolt guide (12) and the piston guide (13), relative to the housing (11), from their initial position, is prevented when the bolt guide (12) and the piston guide (13) are not completely connected by the connection element (16), and a release position (26) in which displacement of the bolt guide (12) and the piston guide (13) relative to the housing (11) from their initial position to their operational position, can take place when the bolt guide (12) and the piston guide (13) are completely connected by the connection element (16).

11 Claims, 3 Drawing Sheets

SETTING TOOL

BACKGROUND OF THE INVENTION

1. Field of the Invention

The present invention relates to a setting tool including a housing, a piston guide displaceably arranged in the housing, a piston displaceably arranged in the hollow space of the piston guide, a bolt guide, and a connection element for fixedly connecting the bolt guide with the piston guide for joint displacement therewith, the bolt guide and the piston guide being displaceable, relative to the housing between an operational position in which the setting process can be initiated, and an initial position corresponding to a non-operational position of the setting tool.

2. Description of the Prior Art

Setting tools of the type described above can be driven with solid, gaseous, or liquid fuels, or compressed air.

In internal combustion-engined setting tools, the drive piston is driven by combustion gases. The drive piston drives, e.g. fastening elements in a constructional component.

In the setting tools, the drive piston is guided in a piston guide, and to-be-set fastening elements are guided in a bolt guide. Often, the bolt guide is connected with the piston guide by thread connection means which is very advantageous for conducting maintenance works associated with maintenance of a setting tool. A threaded connection of the bolt guide with the piston guide is used, e.g., in an internal combustion-engined setting tool of the assignee herein.

The drawback of a threaded connection consists in that in setting tools with a threaded connection between the bolt guide and the piston guide, with incomplete connection of the bolt guide with the piston guide, i.e., when the bolt guide and the piston guide are not connected with each other along the entire length of the thread, the piston guide stores the cartridge or the propellant, and the setting tool can be actuated without being pressed against a constructional component.

Further, with a regulated setting process, the setting tool can malfunction which results in a greater wear in the region of the threaded connection.

Accordingly, an object of the present invention is to so improve a setting tool of the type described above that the drawbacks, which are associated with incomplete connection of the bolt guide with the piston guide, are eliminated.

SUMMARY OF THE INVENTION

This and other objects of the prevent invention, which will become apparent hereinafter, are achieved by providing, in a setting tool of the type described above, a locking member arranged on the setting tool and having a locking position in which displacement of the bolt guide and the piston guide, relative to the housing, from the initial position of the bolt guide and the piston guide to their operational position, is prevented when the bolt guide and the piston guide are not completely connected by the connection means. In a release position, the locking member permits displacement of the bolt guide and the piston guide, relative to the housing from the initial position of the bolt guide and the piston guide to their operational position when the bolt guide and the piston guide are completely connected by the connection means, i.e., when the bolt guide and the piston guide are connected along the entire length of the threaded connection. Thus, with an incomplete connection of the bolt guide with the piston guide, i.e., when the bolt guide is not completely screwed in the piston guide, the setting tool cannot be transferred from its initial position to its operational position. The actuation of the setting tool cannot be achieved by manipulation of the setting tool, e.g., by partial or complete release of the connection between the bolt guide and the piston guide and by manually pushing the bolt guide into the setting tool, which could have lead to actuation of the actuation switch an would have made initiation of a setting process in open air possible.

It is advantageous when a setting tool is provided with control means or a control element that would provide for displacement of the locking member between its locking and release position. The control element can, e.g., be in form of a cone, a curve, an inclined surface, or in form of any other surface that would be contacted by the locking member or a component forming part of the locking member. The control element can. e.g., be arranged between the bolt guide and the piston guide, i.e., in the region of their connection.

According to an advantageous embodiment of the present invention, the locking member is arranged on a lever member one arm of which cooperates with the control means or scans the control means while its other arm carries the locking member. In this way, according to the invention, only one further component is needed for functioning of the locking member, as the control means would act on the locking member through the lever member on which the locking member is arranged.

Advantageously, the locking member is biased toward its locking position by a spring. This insures that the locking member is always in its locking position when the connection between the piston guide and the bolt guide is incomplete.

According to a particularly and advantageous embodiment of the present invention, the control means or the control element is arranged on the bolt guide or at least in the region of the bolt guide.

According to an improved embodiment of the present invention, a sleeve member is arranged between the bolt guide and the piston guide coaxially therewith, and the control means is provided on the sleeve member. The drive piston or its stem can be displaced from the piston guide through the sleeve member opening and into the bolt guide, driving a fastening element, which is located in the bolt guide, out. In this way, the control means, e.g., a control surface can be easily made available, without a need to modify conventional bolt guide and piston guide. By using a sleeve member with a control surface, a conventional setting tool can be easily modified. At one end of the sleeve member, an elastic annular member can be provided with which the sleeve member can be supported against the piston guide or the bolt guide. The elastic annular member permits to press the sleeve or the sleeve member with a predetermined pressure against a part remote from the elastic member (the bolt guide or the piston guide) when connecting the bolt guide with the piston guide.

According to a still further advantageous embodiment of the present invention, the lever member has a pivot with which the lever member is supported against the piston guide. The pivot can be formed by an axle journal, bearing tube, or the like or can be formed by a projection provided on the lever and engaging the surface of the piston guide. The lever member can, in this case, pivot about the point of engagement of the projection, which is provided thereon, with the piston guide.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
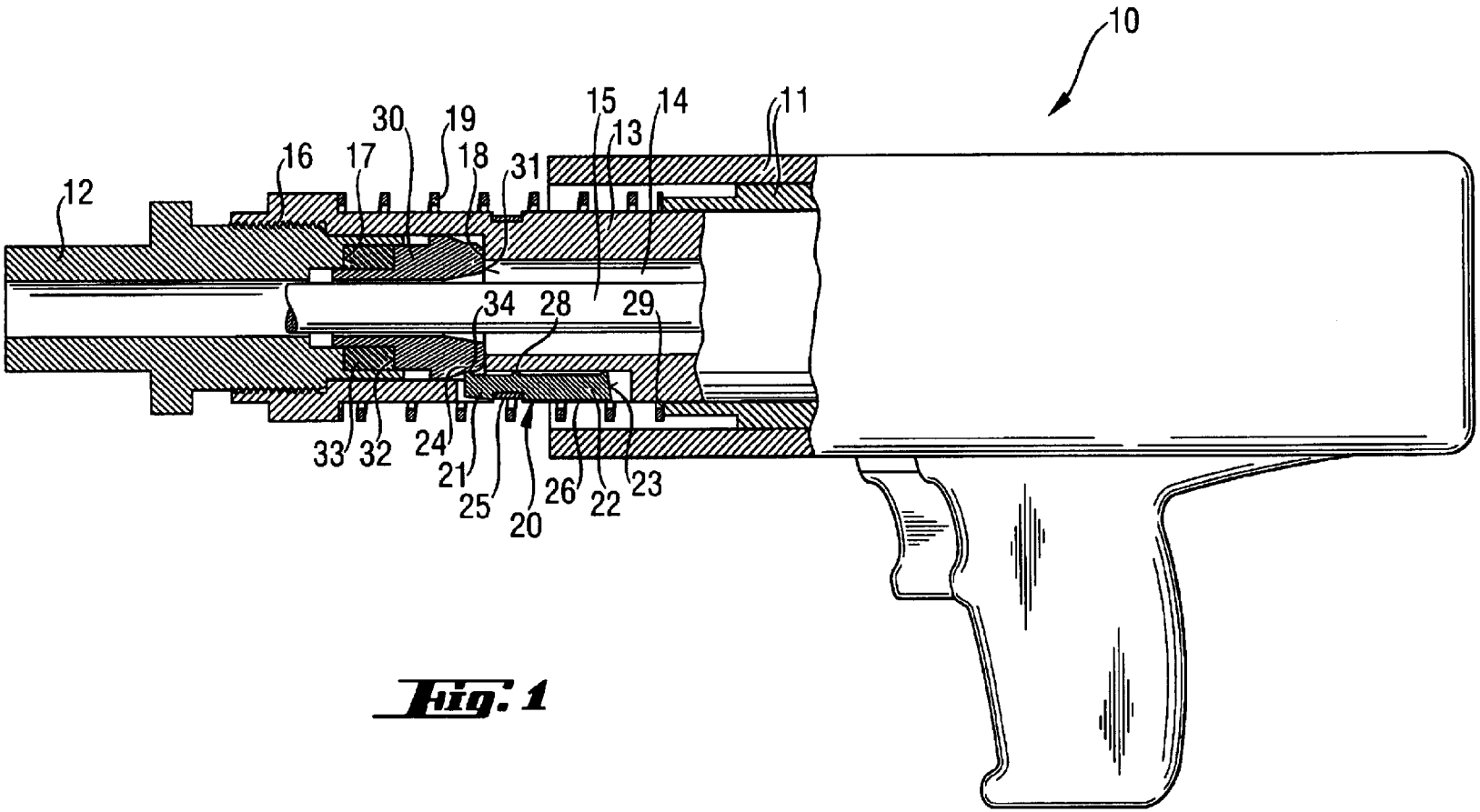
FIG. 1 a side, partially cross-sectional view of a setting tool according to the present invention.
Figure 2:
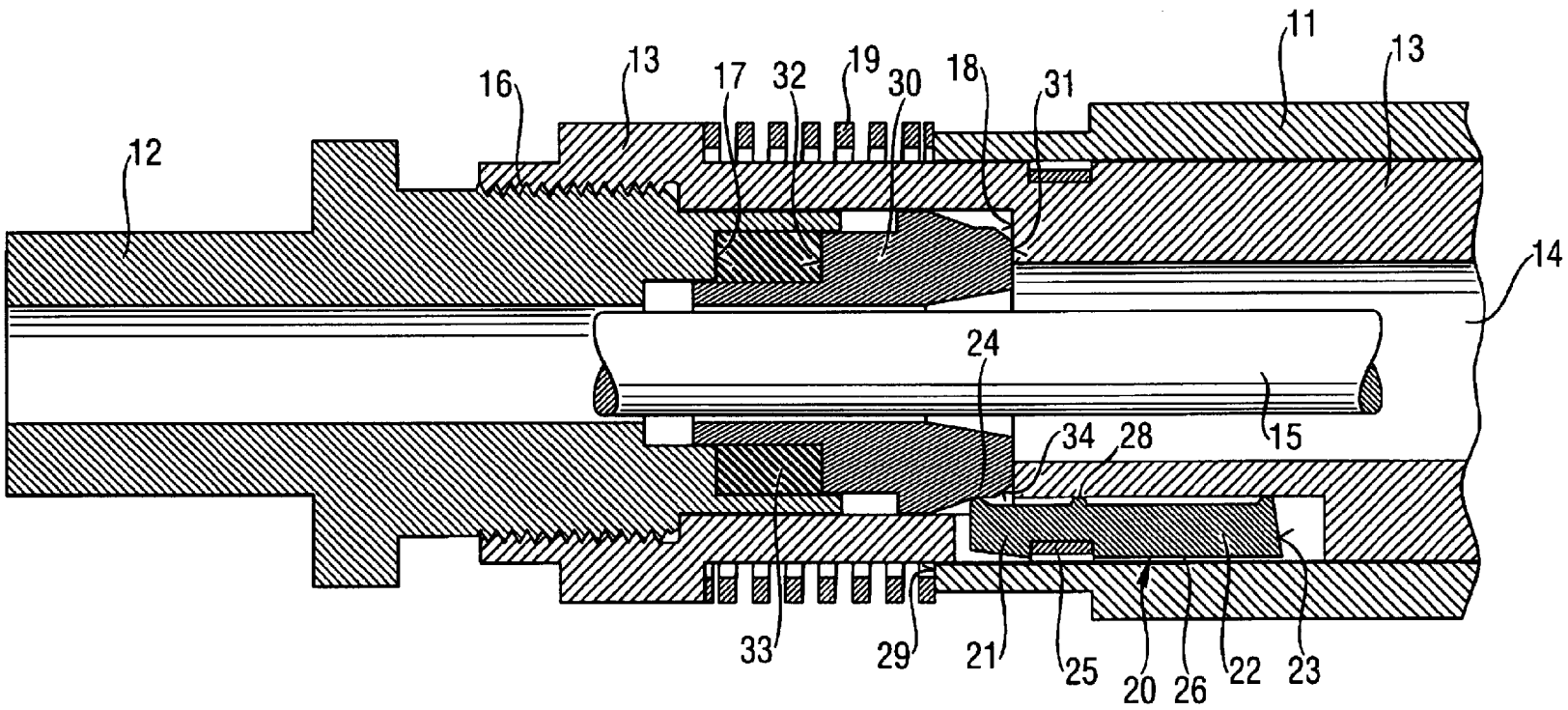
FIG. 2 a longitudinal, partial, cross-sectional view of a section of the setting tool shown in FIG. 1 in a completely mounted condition.
Figure 3:
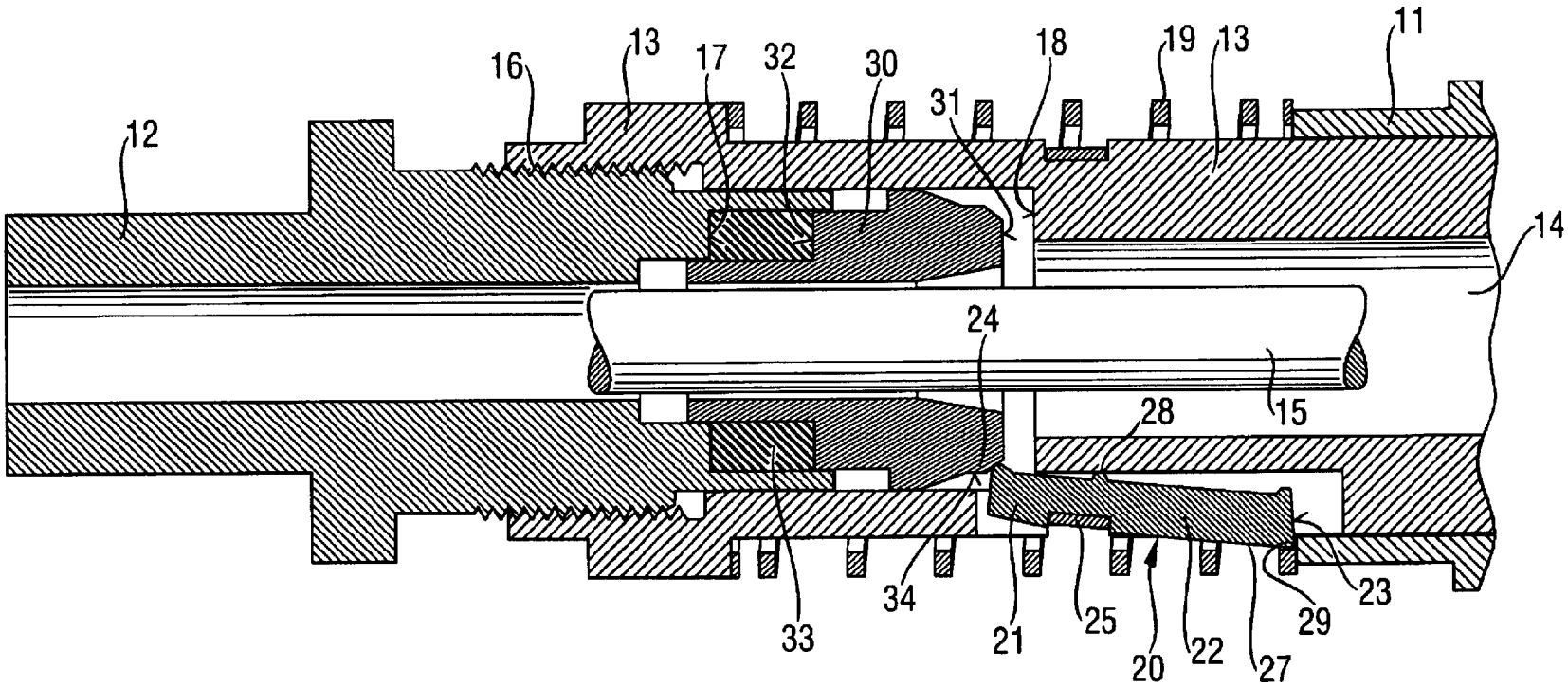
FIG. 3 a longitudinal, partial, cross-sectional view of the section shown in FIG. 2 in a partially mounted condition.

A setting tool 10 according to the present invention, which is shown in FIGS. 1–3, includes a one- or multi-part housing 11 and a piston guide 13 located in the housing 11. A piston 15 is displaceably arranged in a hollow space 14 of the piston guide 13. The piston 15 is driven by a propellant or by products of a reaction such as, e.g., combustion gases, etc. In the embodiment shown in the drawings, the piston guide 13 is displaceably arranged in the sleeve-shaped section of the housing 11 and is supported thereagainst by a spring 19. The spring 19 can be formed, e.g., as a compression spring. In a position of the setting tool when the tool is not pressed against a constructional component, the piston guide 13 extends out of the housing 11 up to a stop. A setting process only then can take place when the setting tool 10 is pressed with its bolt guide 12, which is located, viewed in a setting direction, in front of the piston guide 13, against a constructional component.

In the embodiment shown in the drawings, the bolt guide 12 is connected with the piston guide 13 by thread connections means 16. At the end of the bolt guide 12 adjacent to the piston guide 13, there is provided a sleeve member 30 coaxial with the bolt guide 12. The sleeve member 30 is supported with its support surface 32 against an elastic member 33 located in an opening in the rear end of the bolt guide 12. The elastic member 33 abuts a surface 17 of the bolt guide 12. The elastic member 33 fixedly secures the sleeve member 30 to the bolt guide 12. In its completely screwed-in condition, the rear support surface 31 of the elastic member 30 abuts a front end surface 18 of the piston guide 13. On a periphery of the piston guide 13, there is provided a lever member 20 pivotally supported on the piston guide 13 by a pivot 28. The lever member 20 has a first arm 21 and a second arm 22. A locking member 23 is formed on the second arm 22 of the lever member 20. The first arm 21 of the lever member 20 engages a control surface 34 of a control element 24 provided on the sleeve member 30. In the condition of the setting tool shown in FIGS. 1–2, in which the bolt guide 12 is completely screwed in the piston guide 13, the lever member 20 and, thereby, the locking member 23 is displaced, against the control surface 34, transverse to the tool axis inward to such an extent that the locking member 23 or the lever member 20 extends flush with the piston guide 13. Thereby, the piston guide 13 can be displaced into the sleeve-shaped housing 11 only against the biasing force of the spring 19 (with the locking member 23 being in its release position 26).

FIG. 3 shows a locking position 27 of the locking member 23 of the lever member 20 of the setting tool 10. In the locking position 27, the bolt guide 12 and the piston guide 13 are not completely connected by the thread connection means 16. As a result, the rear surface of sleeve member 30 is spaced from the front or head surface 18 of the piston guide 13. As a result, the lever member 20 is so pivoted with respect to the control surface 34 of the control element 24 of the sleeve member 30 under the action of a spring 25 that the locking member 23, which is provided on the second arm 22 of the lever member 20, engages an edge 29 of the housing 11 upon displacement of the piston guide 13 against the biasing force of the spring 19. Thereby, a further displacement of the piston guide 13 and, consequently, of the bolt guide 12 are blocked. Therefore, it is not possible to effect a setting process.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed:

1. A setting tool, comprising a housing (11); a piston guide (13) displaceably arranged in the housing (11) and having a hollow space (14); a piston (15) displaceably arranged in the hollow space (14) of the piston guide (13); a bolt guide (12); connection means (16) for fixedly connecting the bolt guide (12) with the piston guide (13) for joint displacement therewith, the bolt guide (12) and the piston guide (13) being displaceable, relative to the housing (11), between an operational position in which the setting process can be initiated and an initial position corresponding to a non-operational position of the setting tool (10); and a locking member (23) provided on the setting tool (10) and having a locking position (27) in which displacement of the bolt guide (12) and the piston guide (13), relative to the housing (11), from the initial position of the bolt guide (12) and the piston guide (13) to the operational position thereof, is prevented when the bolt guide (12) and the piston guide (13) are not completely connected by the connection means (16), and a release position (26) in which displacement of the bolt guide (12) and the piston guide (13), relative to the housing (11), from the initial position of the bolt guide (12) an the piston guide (13) to the operational position thereof, can take place when the bolt guide (12) and the piston guide (13) are completely connected by the connection means (16); and means for retaining the locking member in the locking position thereof.

2. A setting tool according to claim 1, further comprising control means (24) for displacing the locking member (23) between the locking (27) and release (26) positions thereof.

3. A setting tool according to claim 2, further comprising a lever member (20) one arm (21) of which cooperates with the control means (24) and another arm (22) of which carries the locking member (23).

4. A setting tool according to claim 1, wherein the retaining means comprises a spring (25) for biasing the locking member (23) to the locking position (27) thereof.

5. A setting tool according to claim 2, wherein the control means (24) has a control surface (34).

6. A setting tool according to claim 5, wherein the control surface (34) is formed as an inclined surface.

7. A setting tool according to claim 2, wherein the control means (24) is provided on the bolt guide (12).

8. A setting tool according to claim 2, further comprising a sleeve member (30) arranged between the bolt guide (12) and the piston guide (13) coaxially therewith, and wherein the control means (24) is provided on the sleeve member (30).

9. A setting tool according to claim 8, further comprising at least one elastic member (33) for supporting the sleeve member on a surface (17) of the bolt guide (12).

10. A setting tool according to claim 9, wherein in the mounted condition of the setting tool (10), the sleeve member (30) is supported, at a rear surface (31) thereof remote from the elastic member (33), against a surface (18) of the piston guide (13).

11. A setting tool according to claim 3, wherein the lever member (20) has a pivot (28) supported against the piston guide (13).

* * * * *